US005320520A

United States Patent [19]

Barth et al.

[11] Patent Number: 5,320,520

[45] Date of Patent: Jun. 14, 1994

[54] GAS BURNER ASSEMBLY FOR SIMULATING A NATURAL LOG FIRE

[75] Inventors: James T. Barth, Plano; Glenn W. Kowald, Carrollton, both of Tex.

[73] Assignee: Eljer Industries, Inc., Dallas, Tex.

[21] Appl. No.: 33,038

[22] Filed: Mar. 18, 1993

[51] Int. Cl.[5] ..... F23Q 2/32

[52] U.S. Cl. ..... 431/125; 126/92 R; 126/512

[58] Field of Search ..... 126/512, 91 R, 92 R, 126/92 AC, 92 A, 152 B, 163 R, 163 A, 85 R; 431/125, 328, 326

[56] References Cited

U.S. PATENT DOCUMENTS

| | | | |
|---|---|---|---|
| 344,808 | 7/1886 | Bradberry | 126/92 R |
| 3,747,585 | 7/1973 | Coats | 431/125 |
| 4,838,240 | 6/1989 | Rieger | 126/512 |
| 4,890,601 | 1/1990 | Potter | 126/512 |
| 4,930,490 | 6/1990 | Allan | 431/125 |
| 4,940,407 | 7/1990 | Rehberg et al. | 126/512 |
| 4,976,253 | 12/1990 | Beal et al. | 126/512 |
| 5,000,162 | 3/1991 | Shimek et al. | 126/512 |
| 5,052,370 | 10/1991 | Karabin | 126/512 |
| 5,139,011 | 8/1992 | Moon | 126/512 |

*Primary Examiner*—James C. Yeung

*Attorney, Agent, or Firm*—Richards, Medlock & Andrews

[57] ABSTRACT

An inexpensive and easily maintained gas burner assembly achieves the manufacturing and maintenance advantages of the conventional sand pan burner design in addition to the heat output and fuel efficiency of more complex burner designs. The invention comprises a tray having a bottom wall and sidewalls defining an interior and an open top. A cover channel having a midsection segment and at least two downwardly depending flanges is adapted to fit in the interior of the tray to form a mixing chamber between the cover channel and the tray. The downwardly depending flanges are spaced away from the sidewalls of the tray to form gaps suitable for filling with a noncombustible granular substance, such as sand or crushed pumice stone. The cover channel additionally comprises at least one projection extending above the top segment and defining at least one burner port. The projection is preferably a longitudinal ridge defining a plurality of burner ports.

11 Claims, 4 Drawing Sheets

GAS BURNER ASSEMBLY FOR SIMULATING A NATURAL LOG FIRE

TECHNICAL FIELD

This invention relates in general to burners for the combustion of gaseous hydrocarbon fuels, such as natural gas, and more particularly, to an inexpensive and easily maintained burner assembly useful for simulating a natural looking log fire in fireplaces fueled by a gaseous hydrocarbon fuel.

BACKGROUND OF THE INVENTION

Because of the availability and comparatively low cost of gaseous hydrocarbon fuels, such as natural gas, propane and butane, they have become widely used in the United States. For example, they are commonly used to fuel appliances such as fireplaces, furnaces, water heaters, stoves, and ovens. Natural-gas, which is composed primarily of methane with small amounts of various heavier gaseous hydrocarbons, is particularly advantageous within the home.

Fuel efficiency is of course an important consideration in the design and operation of any gas fired appliance. By maintaining efficient combustion, heat output is maximized and the production of undesirable and potentially hazardous by-products of combustion, such as carbon monoxide, is minimized. It is well known that complete and efficient combustion of gaseous hydrocarbon fuels is achieved through the use of a relatively small, blue-colored flame. The use of this type of flame is not a significant problem in the design of most gas fired appliances.

However, flame appearance is a major consideration in the design of fireplaces fueled by gaseous hydrocarbon fuels. In such fireplaces, it is desirable to simulate as accurately as possible the flickering, multicolored flame normally produced by a natural log fire. The natural flame is of course very different from the uniform, blue-colored flame which produces complete and efficient combustion. Thus, in the design and operation of hydrocarbon gas fueled fireplaces, a tradeoff exists between efficient combustion on the one hand and a natural looking log fire on the other.

The prior art discloses several approaches that have been taken in the design of gas burner assemblies for fireplaces intended to have a natural looking appearance. One general approach is exemplified by U.S. Pat. No. 344,808 issued in 1886 to Bradberry; U.S. Pat. No. 4,838,240 issued in 1989 to Rieger; and U.S. Pat. No. 4,890,601 issued in 1990 to Potter. These patents disclose the use of what is known in the art as a "sand pan burner." In this type of burner, the gas output ports are buried beneath the surface of a granular, noncombustible substance, such as sand or crushed pumice stone. The gas exiting the burner ports is dispersed as it flows upwardly through the granular substance, and it ignites when it mixes with oxygen in the atmosphere surrounding the burner. The result is a flame pattern which is dispersed along the upper surface of the granular material. In addition, one or more artificial logs may be placed directly on the surface of the granular substance and at other locations within the surrounding firebox to produce a simulated log fire in which the logs are resting on a bed of sand. Furthermore, because of their relatively simple design, gas burners of the sand pan variety are generally inexpensive to manufacture and maintain.

Unfortunately, while sand pan burners produce relatively natural looking fires, they also tend to produce incomplete combustion and poor fuel efficiency. Since the hydrocarbon gas must be forced to flow through the sand or other granular substance, a relatively high back pressure develops which prevents the addition of air (known as "primary air") to the gas in the supply line. Therefore, all of the oxygen for combustion must be supplied from air in the immediate vicinity of the flame (known as "secondary air"). The supply of secondary air is often insufficient to allow for complete combustion. In addition, the flame of a sand pan burner cannot be easily controlled, and often comes into contact with the granular substance or other objects within the firebox. That contact reduces the flame temperature and hampers the combustion process.

As a result of the incomplete combustion, sand pan burners tend to produce unacceptably high levels of carbon (in the form of soot) and carbon monoxide. Emission and Safety Standard Z-21.50 of the American National Standards Institute ("ANSI"), which has been adopted by the American Gas Institute ("AGI"), sets a maximum emission level of 400 parts per million of carbon and carbon monoxide when burning natural gas. It is common for conventional sand pan burners to produce carbon and carbon monoxide at levels very near this limit. Thus, due to high carbon and carbon monoxide emissions, conventional sand pan burners have significant disadvantages when used in a home fireplace.

Another approach in the design of gas burner assemblies is exemplified by U.S. Pat. No. 4,930,490 issued in 1990 to Allan; U.S. Pat. No. 4,940,407 issued in 1990 to Rehberg et al.; U.S. Pat. No. 5,000,162 issued in 1991 to Shimek et al.; and U.S. Pat. No. 5,052,370 issued in 1991 to Karabin. Gas fireplaces of this general approach typically utilize a relatively complex grate structure to position artificial logs so that the unnatural looking, blue-colored flame is largely hidden from view. They also typically utilize complex burner designs having numerous individual parts. Fireplaces of this general type offer the advantage of high fuel efficiency and high heat output with a minimal production of undesirable by-products. Because of their complex design, however, they are often very expensive to manufacture and difficult to maintain.

A need therefore exists for an inexpensive and easily maintained gas burner assembly which can be used to produce a natural looking simulated log fire and which maximizes heat output while avoiding the production of excessive amounts of carbon and carbon monoxide due to incomplete combustion.

SUMMARY OF THE INVENTION

The present invention is an improved gas burner assembly for simulating a natural log fire which achieves the manufacturing and maintenance advantages associated with the conventional sand pan burner design and the fuel efficiency and heat output associated with the more complex and expensive burner designs.

The gas burner assembly of the invention comprises a tray which has a closed bottom and an open top. A gas supply conduit is connected to the tray and includes one or more air inlet ports partially covered by an adjustable collar to regulate the amount of primary air mixed with the hydrocarbon gas within the conduit to produce an initial air/fuel mixture, as is typical with conventional burner systems.

A cover channel is removably positioned in the interior of the tray to form a mixing chamber therebetween. Downwardly directed flanges extend along at least two sides of the cover channel to support the cover channel in the tray, and at least one projection extends above the top segment of the cover channel. The at least one projection defines a plurality of burner ports in communication with the mixing chamber. The projection is preferably a ridge which extends longitudinally from one end of the cover channel to the opposite end of the cover channel and which defines a plurality of burner ports spaced apart along the length of the ridge.

The width of the cover channel is slightly less than the width of the tray so that gaps are present between each of the downwardly directed flanges of the cover channel and the adjacent sidewall of the tray. The gaps between the cover channel flanges and the sidewalls of the tray are at least substantially sealed by filling the gaps with a noncombustible granular substance, such as sand or crushed pumice stone, to a depth sufficient to provide substantial resistance to any gas flow through the gaps. A layer of the noncombustible granular substance can also be placed on the top surface of the cover channel, but the burner ports defined by the longitudinal ridge are left exposed above such layer. Thus, no significant back pressure develops in the gas supply conduit because the initial air/fuel mixture passing from the gas supply conduit through the mixing chamber formed by the tray and the cover channel to the burner ports does not have to flow through any of the granular substance.

The tray and cover channel assembly can be secured to the support surface of a secondary air plenum housing which rests on the floor of the firebox of a fireplace. The gas supply conduit can project through an aperture in the support surface of the secondary air plenum housing. In addition, the secondary air plenum housing defines a plurality of secondary air ports located around the periphery of the tray to allow for the flow of secondary air from within the secondary air plenum housing to the vicinity of the burner ports. Baffles can be positioned spaced from and extending along side of one or more of the tray sidewalls to direct the flow of secondary air toward the burner ports.

In use, primary air enters the gas supply conduit through the primary air inlet ports adjacent the adjustable collar and becomes thoroughly mixed with the hydrocarbon gas as they pass through the mixing chamber to form an initial air/fuel mixture. The initial air/fuel mixture flows through the mixing chamber and is expelled through the burner ports at a level above the upper surface of the layer of the granular substance on top of the cover channel, where the air/fuel mixture ignites. Drawn by the force of natural convection or by mechanical means, for example a fan or blower, secondary air enters the secondary air plenum housing, travels through the secondary air ports to be directed by the baffles toward the flames where the secondary air mixes with the combustion gases produced by the burning of the initial air/fuel mixture. This secondary air flow provides the additional oxygen necessary to achieve complete combustion of the hydrocarbon gas fuel.

A natural looking log fire can be simulated by placing an artificial log directly on the granular substance so that the length of the log extends generally parallel to the length of the tray and cover channel assembly and thus at least generally parallel to the exposed apex of the elevated ridge containing the burner ports. Additional artificial logs can be placed at various locations within the firebox. A quantity of artificial ember material, such as mineral wool or vermiculite, can be distributed above the burner ports and around the base of the artificial log resting on the granular substance to simulate burning embers. Because the transverse dimension of the exposed apex of the elevated ridge is relatively small, the assembly has the outward appearance of a log surrounded by burning embers resting on a bed of sand. In addition, the flow of secondary air, as directed by the baffles, causes the flames to flicker in a manner similar to those of a natural log fire.

Therefore, the gas burner assembly of the invention is capable of achieving complete and efficient combustion of the hydrocarbon gas in addition to simulating a natural log fire. Because the burner is of a relatively simple design, its major components may be fabricated from readily available materials using conventional forming machines and techniques. Thus, the burner assembly is inexpensive to manufacture because there are little or no tooling costs. The simple design additionally allows for easy cleaning and maintenance of the burner assembly.

BRIEF DESCRIPTION OF THE DRAWINGS

A complete understanding of the invention and its advantages will be apparent from the following detailed description of the invention taken in conjunction with the accompanying drawings in which.

DETAILED DESCRIPTION OF THE INVENTION

Figure 1:
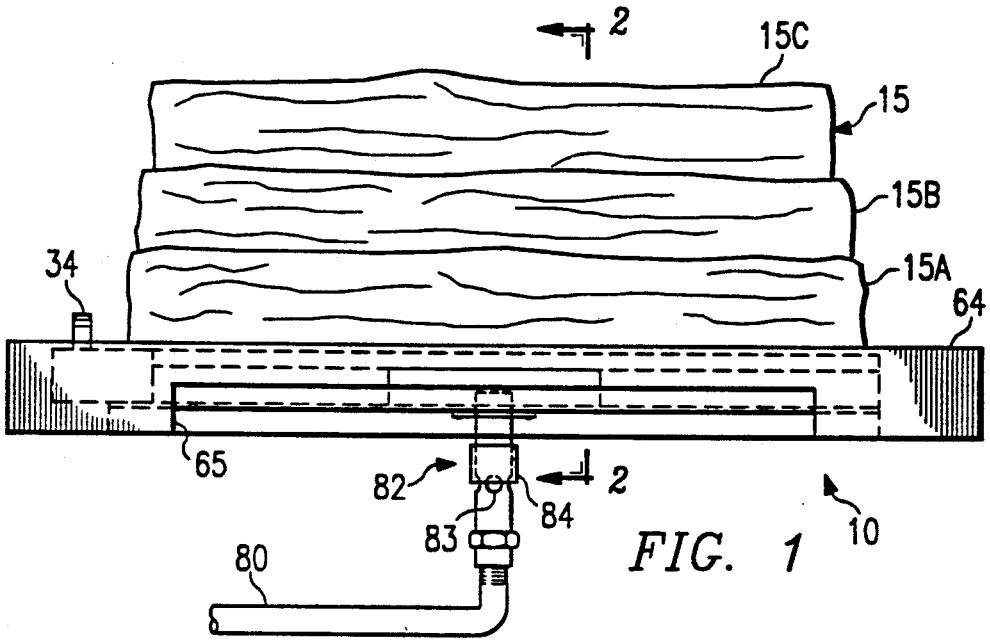
FIG. 1 is a front view of the gas burner assembly of the invention as used in conjunction with artificial logs and artificial ember material to simulate a natural log fire.
Figure 2:
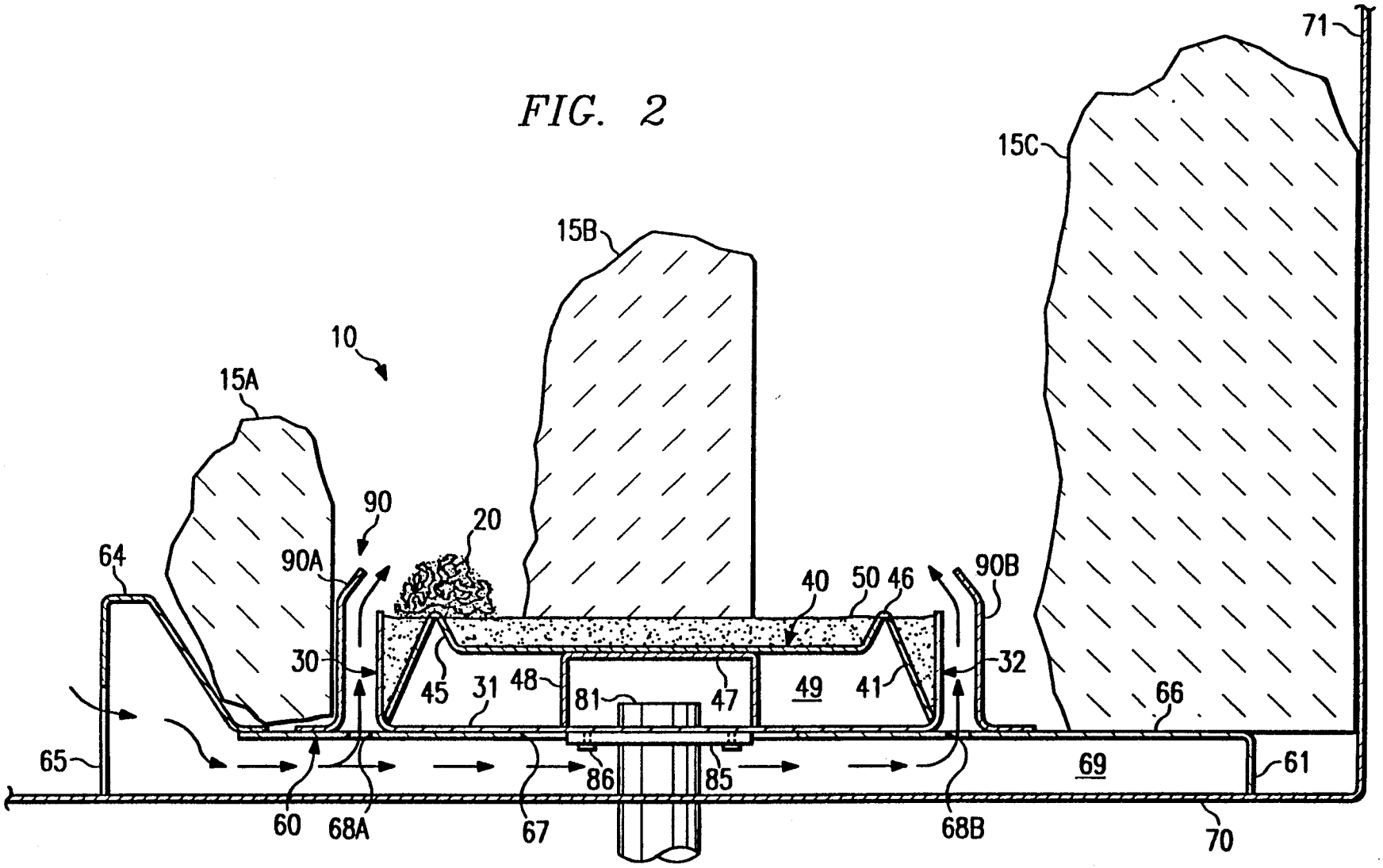
FIG. 2 is a sectional view taken along the line 2—2 shown in FIG. 1.

In FIGS. 1 and 2, the gas burner assembly 10 is shown in use with artificial logs 15 and artificial ember material 20 to simulate a natural log fire. While this is a preferred use, gas burner assembly 10 can be used in any application in which the complete and efficient combustion of a hydrocarbon gaseous fuel is desired. Gas burner assembly 10 comprises secondary air plenum housing 60, which rests on floor 70 of the firebox of a fireplace. Secondary air plenum housing 60 has a generally horizontal support segment 66 which is supported along its rear edge by downwardly depending flange 61 and along its lateral edges by downwardly depending flanges 62 and 63 (FIG. 4) which project downwardly into contact with floor 70. The front edge of secondary air plenum housing 60 is supported by secondary air inlet member 64 having at least one slot 65 therein which allows air to flow into the secondary air plenum chamber 69 which is formed between secondary air plenum housing 60 and floor 70.

Figure 3:
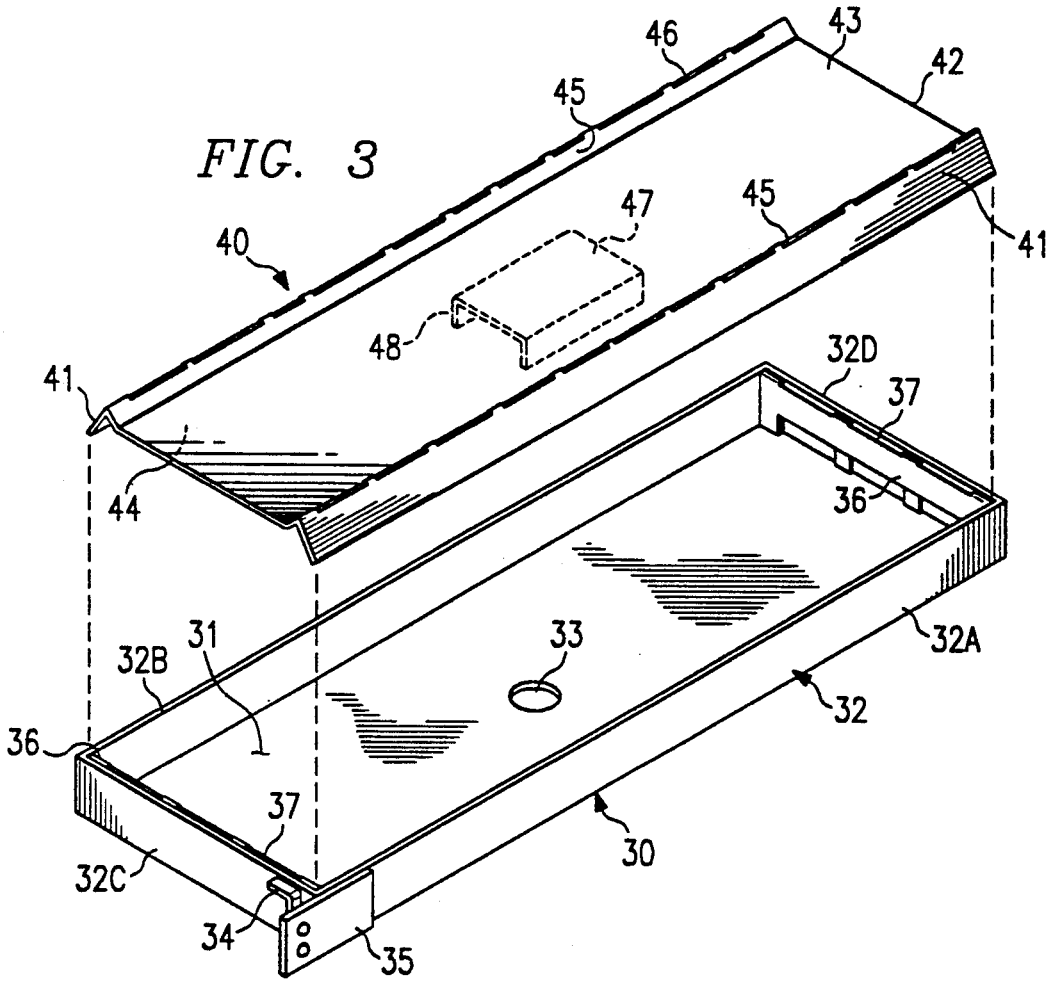
FIG. 3 is a perspective view of the tray and cover channel of the gas burner assembly showing how those components are assembled.
Figure 5:
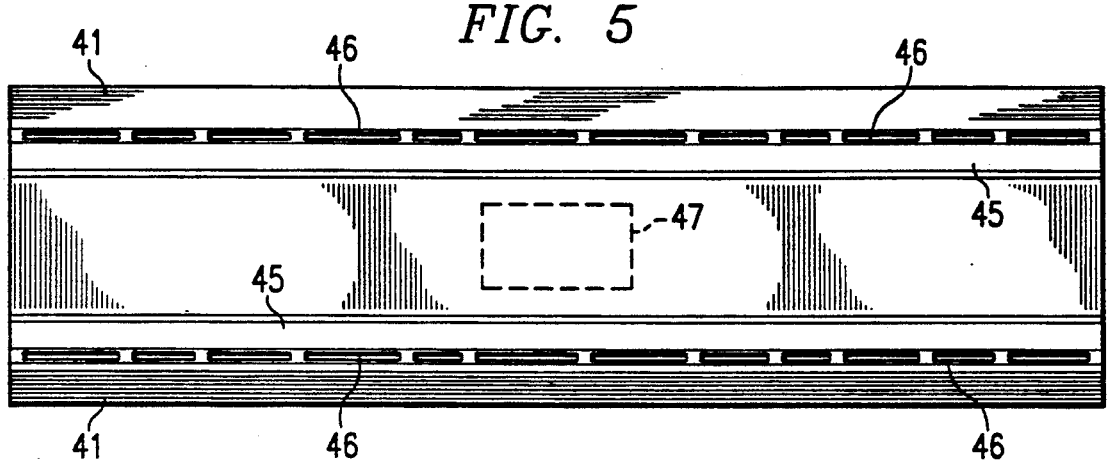
FIG. 5 is a top view of the preferred embodiment of the cover channel.

As shown in FIGS. 2 and 3, the tray 30 is generally rectangular in shape with a bottom wall 31, front sidewall 32A, rear sidewall 32B, and end sidewalls 32C and 32D, with the sidewalls meeting at the corners of the tray 30. The bottom wall 31 of tray 30 is positioned on and preferably attached to the top surface of support segment 66 of secondary air plenum housing 60. The cover channel 40 is preferably a single sheet of metal which has two inverted V-shaped bends formed therein extending parallel to each other from one end of the sheet to the opposite end of the sheet, to form a generally horizontal, longitudinally extending midsection segment 42, two longitudinally extending flanges 45 which extend upwardly and outwardly from opposite longitudinal sides of segment 42, and two longitudinally extending flanges 41 which each extend downwardly and outwardly from the outer longitudinal edge of a respective one of the upwardly extending flanges 45. The midsection segment 42 has an upper surface 43 and a lower surface 44. Each ridge formed by the joinder of an upwardly and outwardly extending flange 45 and a downwardly and outwardly extending flange 41 juts upwardly from midsection segment 42 and defines at least one burner port 46. As shown in FIGS. 3 and 5, each ridge contains a series of slots in its apex to define a plurality of burner ports 46 which are spaced apart from each other along the length of the respective ridge. In a preferred embodiment, burner ports 46 are generally rectangular shaped and are spaced at predetermined intervals along the lengths of the ridges. The length of burner ports 46 can vary the lengths of the ridges. The intervals between adjacent burner ports 46 can also vary along the lengths of the ridges. Of course, other shapes for burner ports 46, such as circular, are also suitable and are within the scope of the invention. The inverted V-shaped cross section of each ridge provides advantageous flow characteristics for the initial air/fuel mixture as it exits the mixing chamber 49 through the burner ports 46.

The dimensions of cover channel 40 are slightly less than the corresponding dimensions of tray 30 so that cover channel 40 can be removably positioned within the interior of tray 30, with a gap between each of the depending flanges 45 and the adjacent sidewall of the tray 30. The length of the cover channel 40 is preferably equal to the length of the mixing chamber 49. The height of the downwardly extending flanges 41 is substantially greater than the height of the upwardly extending flanges 45 so that the cover channel 40 can be supported by the flanges 41 resting on the bottom wall 31 of the tray 30, with the apexes of the ridges being located at or just below the top edge of the tray sidewalls. Granular substance 50 is positioned in the gaps between the downwardly depending flanges 41 of the cover channel 40 and the sidewalls 32 of tray 30 to a depth which is sufficient to provide a substantial resistance to gas flow through the gaps. A layer of the granular substance 50 can also be formed in the space defined by the midsection segment 42, upwardly extending flanges 45, and the carry-over assemblies 36 attached to end sidewalls 32C and 32D of the tray 30. This top layer provides a natural looking base for supporting artificial log 15B, partially isolates the front burner port area from the rear burner port area, and also provides resistance to any gas flow between the ends of the cover channel 40 and the carry-over assemblies 36 attached to end sidewalls 32C and 32D.

Baffles 90 can be attached to support segment 66 of secondary air plenum housing 60 so that each baffle is positioned adjacent to but spaced from a respective one of the four sidewalls 32 of tray 30 and extends parallel to that sidewall. Each baffle 32 is preferably at least substantially coextensive in length with the tray sidewall 32 with which it is associated.

To simulate the appearance of a natural log fire, artificial logs 15 can be placed at various locations within the firebox of the fireplace. A first artificial log 15A can be placed between the forward baffle 90A and secondary air inlet member 64. A second artificial log 15B can be placed directly on the layer of granular substance 50 on cover channel 40. Further, a third artificial log 15C can be placed so that its bottom rests on secondary air plenum housing 60 and its backside is adjacent to the rear wall 71 of the firebox, as shown best in FIG. 2. To provide a more natural looking stair stepped appearance, artificial log 15B can be slightly larger than artificial log 15A, and artificial log can be slightly larger than artificial log 15B.

As shown in FIG. 3, the aperture 33 for the gas supply conduit 80 is preferably located in bottom wall 31; however, conduit aperture 33 could also be located in one of the sidewalls 32 of tray 30 with or without a perforated dispersal conduit extending from the aperture 33 toward other portions of the mixing chamber 49. A conventional pilot assembly 34, for example Model Q314 currently available from Honeywell, Inc., can be attached to tray 30 by bracket 35. Pilot assembly 34 can be attached at a corner of tray 30; however, other locations for the attachment of pilot assembly 34 to tray 30 are also suitable. Pilot assembly 34 is connected to a supply of gaseous hydrocarbon fuel. In addition, carry-over assemblies 36 are attached to the interior face of the two end sidewalls 32C and 32D of tray 30. Carry-over assemblies 36 define carry-over ports 37 which produce flames at the lateral edges of tray 30 and carry flame from the pilot assembly 34 to the forward burner ports and to the rear burner ports. Each of carry-over assemblies 36 can be fabricated from a flat sheet of material. Tray 30 can be formed from a flat sheet of material using conventional metal forming and spot welding techniques.

In the embodiment shown in FIG. 3, a plurality of burner ports 46 are defined by the apex of each ridge 45. Each burner port 46 preferably has a rectangular shape with the ratio of the length to the width being sufficiently great to produce a relatively long flame front extending at least substantially parallel to the length of the tray 30. However, burner ports of other shapes, such as square or circular, can be used. In addition, burner ports 46 can be spaced at irregular intervals along the length of each ridge to produce randomly spaced flames for a more natural looking flame pattern.

Cover channel 40 can additionally comprise a flow diverter 47 attached to the lower surface 44 of midsection segment 42. Flow diverter 47 can have an inverted U-shape configuration when viewed along the longitudinal axis of the assembly. Flow diverter 47 can have longitudinally extending flanges 48, each of which projects downwardly in a direction generally perpendicular to lower surface 44. Cover channel 40 can be formed from a flat sheet of material using conventional metal forming techniques. Flow diverter 47 can be formed from a separate sheet of material and attached to lower surface 44 by conventional spot welding. Flow diverter 47 serves to supply a relatively uniform amount of initial air/fuel mixture along the length of the ridges. The flow of the initial air/fuel mixture is laterally diverted by flow diverter 47 as it exits free end 81 of gas supply conduit 80. In this manner, each burner port 46 receives approximately the same flow rate of initial air/fuel mixture.

Gaseous hydrocarbon fuel can be supplied to burner 10 by gas supply conduit 80 (FIG. 1), which can be connected to tray 30 at conduit aperture 33 such that the free end 81 of gas supply conduit 80 projects above bottom wall 31 within the space defined by flow diverter 47. At a point exterior to the tray and cover assembly, the gas supply conduit 80 includes adjustable air inlet means 82 which comprises one or more air input apertures 83 and a slidable collar 84. The interior of adjustable air inlet means 82 contains an orifice (not shown) which is positioned adjacent air input apertures 83 and which is oriented to discharge toward free end 81. The venturi effect caused by the discharge of natural gas from the orifice draws air surrounding the gas supply conduit 80 into the interior of the gas supply conduit 80 through air input apertures 83. This primary air combines with the hydrocarbon gas inside gas supply conduit 80 to produce an initial air/fuel mixture which is passed through the remainder to conduit 80 into the mixing chamber 49.

The amount of primary air allowed to flow into gas supply conduit 80 can be regulated by positioning slidable collar 84. To reduce the amount of primary air, slidable collar 84 can be positioned so that it covers a greater portion of air input apertures 83. To increase the amount of primary air, slidable collar 84 can be positioned so that it covers a lesser portion of the air input apertures 83. After slidable collar 84 has been adjusted to provide the correct air/fuel mixture for complete and efficient combustion, it can be held in place with a conventional set screw (not shown).

To assemble burner 10, gas supply conduit 80 can be connected to tray 30 at conduit aperture 33 by fastening conduit flange 85 to bottom wall 31 using screws 86. Cover channel 40 is removably positioned in the interior of tray 30 so that downwardly depending flanges 41 come into contact with bottom wall 31 of tray 30 to form a mixing chamber 49 between cover channel 40 and tray 30. When cover channel 40 is positioned in the interior of tray 30, gaps suitable for filling with granular substance 50 are formed between downwardly depending flanges 41 and the adjacent sidewalls 32 of tray 30. The lateral edges of cover channel 40 come into contact with carry-over assemblies 36 such that carry-over ports 37 remain exposed above the upper surface of the layer of granular material on top of midsection segment 42. Straight flanges 48 of flow diverter 47 come into contact with bottom wall 31 of tray 30 and provide additional support for the central portion of midsection segment 42.

Figure 4:
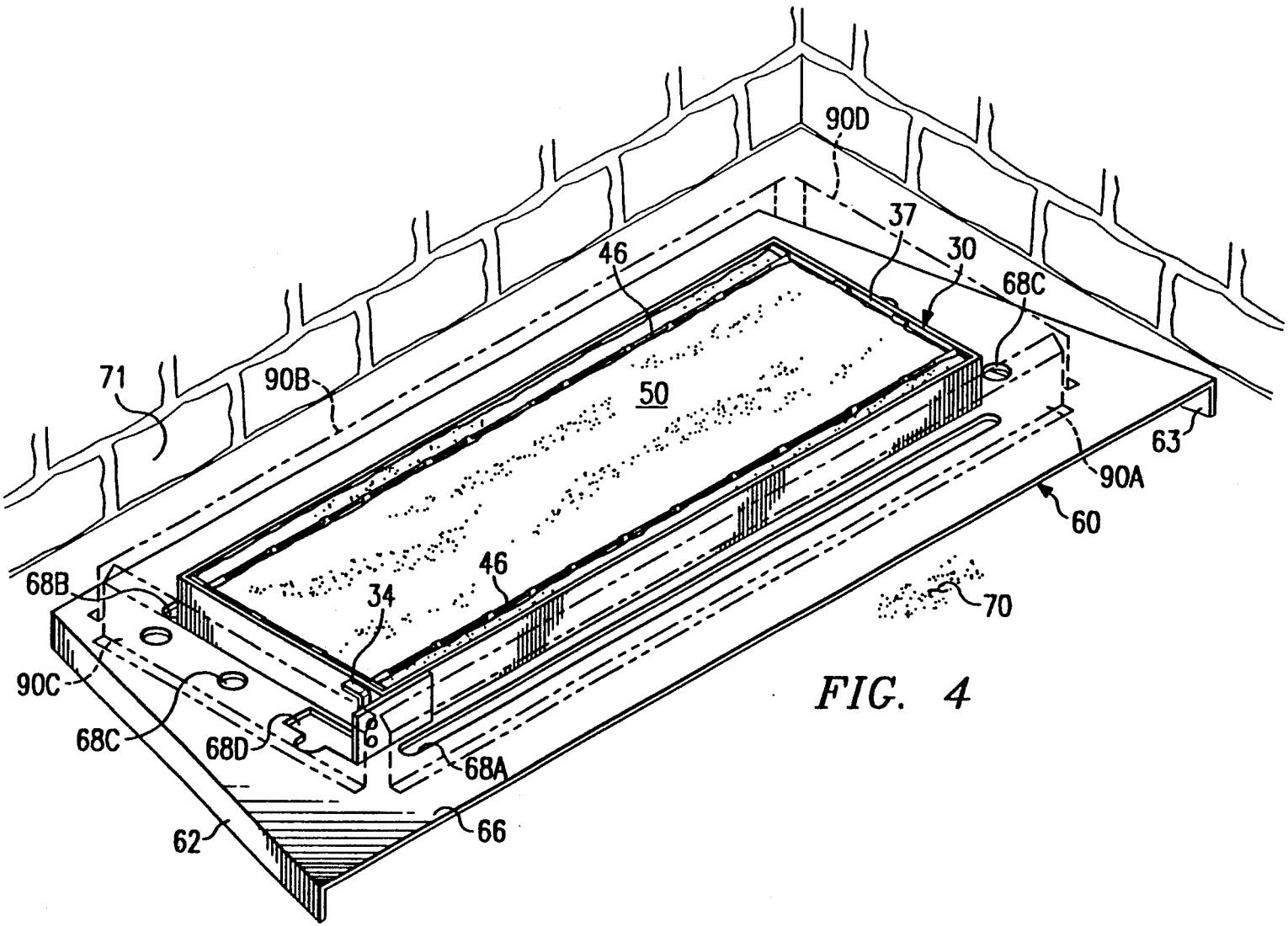
FIG. 4 is a perspective view of the gas burner assembly with some components shown in phantom for clarity.

As shown best in FIG. 4, tray 30, containing cover channel 40, can be positioned on and secured to support segment 66 of secondary air plenum housing 60. Gas supply conduit 80 projects through center aperture 67 (FIG. 2) defined by support segment 66 of secondary air plenum housing 60. Support segment 66 of secondary air plenum 60 additionally defines a plurality of secondary air ports 68 which can be disposed around the periphery of tray 30. Specifically, secondary air port 68A can have the shape of an elongated slot and can be positioned immediately in front of tray 30 and extend at least substantially parallel to the front sidewall of tray 30. Similarly, secondary air port 68B also can have the general shape of an elongated slot positioned to the rear of tray 30 and extending parallel to the rear sidewall of tray 30. Secondary air ports 68C having a generally circular or oval shape can be located adjacent the lateral sides 32C and 32D of tray 30. Secondary air port 68D can be located adjacent pilot assembly 34 and is preferably slightly larger than secondary air ports 68C to allow for a larger flow of secondary air to supply pilot assembly 34.

Of course, other shapes of secondary air ports 68 are also suitable. For example, secondary air ports 68 in the general shape of an elongated slot could be used on all sides of tray 30. Further, a plurality of spaced apart secondary air ports 68 of a generally circular shape could also be used all around tray 30.

Baffles 90, shown in phantom in FIG. 4, can be attached to support segment 66 of secondary air plenum housing 60 outwardly from secondary air ports 68. Baffle 90A can be positioned outwardly from secondary air port 68A and can extend generally parallel to sidewall 32A of tray 30. Baffle 90B can similarly be positioned outwardly from secondary air port 68B and can extend generally parallel to sidewall 32B. In addition, baffles 90C and 90D can be positioned outwardly from secondary air ports 68C and 68D, respectively, and can extend generally parallel to sidewalls 32C and 32D, respectively.

The gaps formed between downwardly depending flanges 41 and sidewalls 32 are filled with granular substance 50 to a depth sufficient to provide substantial resistance to the flow of initial air/fuel mixture through the gaps from mixing chamber 49. However, burner ports 46 are left exposed to allow for the free flow of the initial air/fuel mixture exiting mixing chamber 49 through burner ports 46. In addition, a layer of granular substance 50 can be deposited on upper surface 43 of top segment 42 of cover channel 40 to a depth sufficient to provide substantial resistance to the flow of initial air/fuel mixture through the Joints between the lateral edges of cover channel 40 and carry-over assemblies 36. However, carry-over ports 37 are left exposed to allow for the free flow of initial air/fuel mixture exiting mixing chamber 49 through carry-over ports 37.

Sand and crushed pumice stone are suitable materials for use as granular substance 50. Of course, the primary consideration in selecting a material for use as granular substance 50 is that it must withstand high temperatures and be noncombustible.

Figure 6:
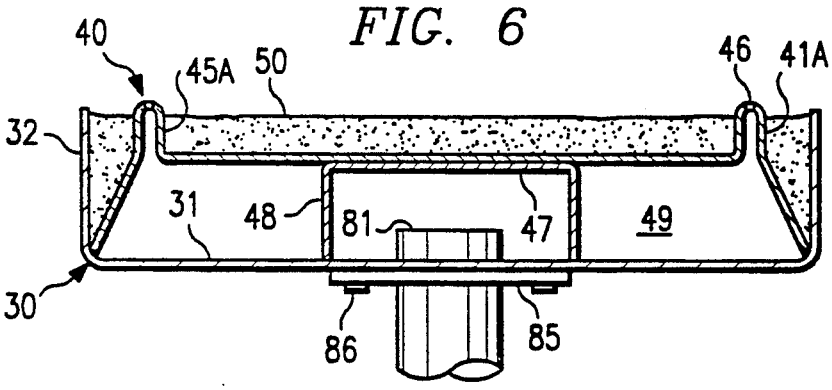
FIG. 6 is a sectional view of an alternative embodiment of the cover channel in place within the tray and covered by the granular substance.

An alternative embodiment of cover channel 40 is depicted in FIG. 6. In this alternative embodiment, the inner flanges 45*a* and the top portion of the outer flanges 41A have a cross section in the shape of an inverted U, with the burner ports being located in the curved top portion of the inverted U. Cover channel 40 of this alternative embodiment is as described above in all other respects.

In operation, gaseous hydrocarbon fuel flows through gas supply conduit 80 and mixes with air entering the conduit through adjustable air inlet means 82. The two components proceed through gas supply conduit 80 and enter mixing chamber 49, where additional mixing of the air and gas fuel occurs, thus forming an initial air/fuel mixture.

The initial air/fuel mixture exits burner 10 through burner ports 46 and is ignited, after which it comes into contact with secondary air in the vicinity of burner ports 46. Slidable collar 84 of adjustable air inlet means 82 can then be adjusted as previously described to provide the correct amount of primary air. The heat produced by the flame initiates natural convection in the air surrounding burner 10. Drawn by the forces of natural convection, secondary air enters secondary air chamber 49 formed by secondary air plenum 60 through slot 65 in secondary air inlet member 64. Secondary air then flows through secondary air ports 68 and is directed by baffles 90 toward the flames. The secondary air provides the additional oxygen necessary to achieve complete and efficient combustion of the hydrocarbon fuel. The flow of secondary air also causes the flames to flicker and thereby produces a natural looking flame appearance.

When it is desired to use burner 10 to simulate a natural log fire, artificial logs 15 (FIGS. 1 and 2) can be placed directly on granular substance 50 and at other locations within the firebox. Artificial logs 15 are preferably made of ceramic, cast-concrete, ceramic fiber, or some other noncombustible material which can withstand high temperatures. Additionally, artificial ember material 20 can be distributed around the base of artificial logs 15 and above burner ports 46 to simulate burning embers. Flames from burner ports 46 heat the artificial ember material 20, thereby causing material 20 to incandesce. Mineral wool, vermiculite, or any other suitable noncombustible material can be used as artificial ember material 20. Of course, additional artificial logs 15 and additional artificial ember material 20 can be placed on burner 10 to provide the particular appearance desired.

Therefore, gas burner assembly 10 achieves the fuel efficiency of more complex burner designs and provides the aesthetically pleasing features of the conventional sand pan burner design. Complete combustion of the hydrocarbon gas fuel can be achieved through use of the adjustable air input means and because the air/fuel mixture is ignited at precise burner ports 46 at controlled locations. The flame therefore does not come into contact with the granular substance or other objects within the burner area.

In addition, gas burner assembly 10 can be used to create a natural looking log fire. Artificial logs 15 rest on a bed of sand or some other granular substance just as with a conventional sand pan burner. Artificial ember material 20 adds to the realistic appearance.

Further, because of its relatively simple design, gas burner assembly 10 is very inexpensive to manufacture. The major components, tray 30, cover channel 40, and secondary air plenum housing 60 are easily fabricated from sheet metal using conventional metal forming and spot welding techniques. Sophisticated tooling and manufacturing techniques are not required.

Burner 10 is also easily disassembled for maintenance. Complete access to mixing chamber 49 can be obtained by simply removing granular substance 50 and lifting cover channel 40 out of tray 30. This is not possible with more complex burner designs in which the components are permanently joined together.

Although the preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit and scope of the invention. For example, tray 30 can have other shapes, such as a square, circular or oval shape. Cover channel 40 can have downwardly depending flanges 41 extending from all four edges to provide for gaps on all sides of the cover channel to be filled with granular material. The ridges can be formed at locations spaced inwardly from the downwardly depending flanges 41 by the use of additional folding steps in the fabrication process. While the preferred embodiment has been illustrated as having two ridges, a single ridge or more than two ridges can be utilized. While it is presently preferred to form the ridges coextensively with the cover channel by folding the sheet metal, the projections can be formed by embossing the sheet metal such that the horizontal length of the projections is less than the length of the cover channel and such projections can be arranged in a staggered fashion. The invention is therefore intended to encompass such rearrangements, modifications, and substitutions of parts and elements.

What is claimed is:

1. A gas burner assembly, comprising:

a tray having a bottom wall and sidewalls defining an interior and an open top;

a cover channel having a midsection segment extending between at least two downwardly depending flanges, said cover channel having at least one projection jutting upwardly from the top segment and defining at least one burner port;

said cover channel being adapted to fit within the interior of said tray such that the at least two downwardly depending flanges of said cover channel contact the bottom wall of said tray to form a mixing chamber between said cover channel and said tray, the at least two downwardly depending flanges of said cover channel and the adjacent sidewalls of said tray forming a gap therebetween suitable for filling with said granular substance; and a secondary air plenum housing having a support segment and forming a secondary air chamber, the support segment of said secondary air plenum housing being adapted to support the bottom wall of said tray and defining a plurality of secondary air ports located outwardly from the periphery of said tray.

2. A gas burner assembly as recited in claim 1, wherein the at least one projection is at least one ridge extending longitudinally along said cover channel, the ridge defining a plurality of burner ports.

3. A gas burner assembly as recited in claim 2, wherein each ridge of said cover channel has an inverted V-shaped cross section.

4. A gas burner assembly as recited in claim 2 wherein each ridge of said cover channel has an inverted U-shaped cross section.

5. A gas burner assembly as recited in claim 1, further comprising baffles attached to the support segment of said secondary air plenum housing adjacent the secondary air ports, said baffles being adapted to direct the flow of secondary air passing through the secondary air ports toward said tray.

6. A gas burner assembly, comprising:

a tray having a bottom wall and sidewalls defining an interior and an open top;

a cover channel having a midsection segment extending between at least two downwardly depending flanges, said cover channel having at least one ridge jutting upwardly from the top segment and extending longitudinally along said cover channel, the at least one ridge defining a plurality of burner ports, said cover channel being adapted to fit within the interior of said tray such that the at least two downwardly depending flanges of said cover channel contact the bottom wall of said tray to form a mixing chamber between said cover channel and said tray, the at least two downwardly depending flanges of said cover channel being spaced away from the adjacent sidewalls of said tray forming a gap therebetween suitable for filling with a granular substance; and a secondary air plenum housing having a support segment and downwardly depending flanges adapted to contact the floor of a firebox to form a secondary air chamber between said secondary air plenum housing and the floor of the firebox, the support segment being adapted to support the bottom wall of said tray and defining a plurality of secondary air ports disposed around the periphery of said tray.

7. A gas burner assembly as recited in claim 6, wherein the at least one ridge of said cover channel has an inverted V-shaped cross section.

8. A gas burner assembly as recited in claim 6, wherein the at least one ridge of said cover channel has an inverted U-shaped cross section.

9. A method of making gas burner assembly, comprising the steps of:

forming a tray having a bottom wall and sidewalls defining an interior and an open top;

forming a cover channel having a midsection segment extending between at least two downwardly depending flanges, the cover channel having at least one projection jutting upwardly from the top segment and defining at least one burner port;

adapting the cover channel to fit in the interior of the tray such that the at least two downwardly depending flanges of the cover channel contact the bottom wall of the tray to form a mixing chamber between the cover channel an the tray, the at least two downwardly depending flanges of the cover channel being spaced away from the sidewalls of the tray forming gaps therebetween suitable for filling with a granular substance; and forming a secondary air plenum housing having a support segment and downwardly depending flanges adapted to contact the floor of a firebox to form a secondary air chamber between the secondary air plenum housing and the floor of the firebox, the support segment of the secondary air plenum being adapted to support the bottom wall of the tray and defining a plurality of secondary air ports located outwardly from the periphery of the tray.

10. A method of making a gas burner assembly as recited in claim 9, further comprising the steps of:

securing the bottom wall of the tray to the support surface of the secondary air plenum housing;

removably positioning the cover channel in the interior of the tray such that a mixing chamber is formed between the cover channel and the bottom of the tray and gaps are formed between the at least two downwardly depending flanges and the sidewalls of the tray.

11. A method of making a gas burner assembly as recited in claim 10, further comprising the step of filling the gaps between the at least two downwardly directed flanges and the sidewalls of the tray with a granular substance such that the at least one burner port is left exposed.

* * * * *